US005969018A

United States Patent [19]

Shah et al.

[11] Patent Number: 5,969,018

[45] Date of Patent: Oct. 19, 1999

[54] FORMALDEHYDE FREE PRINT BINDER

[75] Inventors: Pravinchandra Kantilal Shah, Westlake; Pankaj Rugnath Panchmatia, Broadview Heights, both of Ohio

[73] Assignee: The B.F. Goodrich Company, Akron, Ohio

[21] Appl. No.: 08/583,261

[22] Filed: Jan. 5, 1996

[51] Int. Cl.[6] ..... C08J 3/00; C08K 5/49; C08K 5/52; C08L 23/00

[52] U.S. Cl. ..... 524/140; 524/115; 524/136; 524/145

[58] Field of Search ..... 524/115, 140, 524/136, 145

[56] References Cited

U.S. PATENT DOCUMENTS

| | | | |
|---|---|---|---|
| 4,357,442 | 11/1982 | Shah | 524/745 |
| 4,447,570 | 5/1984 | Cook et al. | 524/127 |
| 4,524,093 | 6/1985 | Devry | 427/389.9 |
| 5,137,963 | 8/1992 | Stack | 524/519 |
| 5,198,492 | 3/1993 | Stack | 524/501 |
| 5,278,222 | 1/1994 | Stack | 524/502 |
| 5,435,879 | 7/1995 | Knutson et al. | 156/327 |

FOREIGN PATENT DOCUMENTS

WO9631565 10/1996 WIPO .

OTHER PUBLICATIONS

Grant & Hackh's Chemical Dictionary, 5th ed., 1987, pp. 24, 49, 53, and 115.

The BFGoodrich Company, Specialty Chemicals, Technical Data PrintRite™ Binder 591, Carbopol® Thickeners PrintRite™ Binders and Auxiliaries, "High Performance Textile Polymers and Chemicals", Apr. 1994.

The BFGoodrich Company, Specialty Polymers & Chemicals Division, Technical Data PrintRite™ Binder 592, Carbopol® PrintRite™, "High Performance Polymers for Textiles", Sep. 1993.

The BFGoodrich Company, Specialty Polymers & Chemicals Division, Technical Data PrintRite™ Binder 594, Carbopol® PrintRite™, "High Performance Polymers for Textiles", Sep. 1993.

Morton International, Inc., "Morton Waterbased Polymers, Polybinder® X401", Jun. 1994.

Morton International, Inc., "Morton Waterbased Polymers, Polybinder® X418", Jun. 1994.

*Primary Examiner*—Patrick D. Niland

*Attorney, Agent, or Firm*—George W. Moxon, II

[57] ABSTRACT

An aqueous dispersion of 0.1 to 15 percent by weight of at least one phosphate ester and a copolymer formed by the coploymerization of a monomer mixture comprising:

a) 0.1 to 15 percent by weight of at least one dicarboxylic acid, b) 0.1 to 10 percent by weight of at least one functional monomer is represented by the following formula:

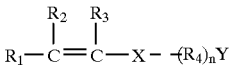

where $R_1$, $R_2$ and $R_3$ are hydrogen or a methyl group, $R_4$ is an alkyl containing 1 to 4 carbon atoms, n is 0 or 1, X is selected from the group consisting of hydrogen, carboxyl, phenyl, aryl, alkyl or alkaryl groups containing 1 to 30 atoms, and Y is a nucleophilic group selected from —OH, —$NH_2$ or

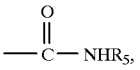

or

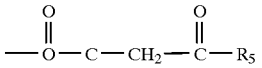

wherein $R_5$ is a hydrogen, an alkyl containing 1–20 carbon atoms, or an aryl group, and c) more than 80% by weight of backbone monomers.

23 Claims, No Drawings

FORMALDEHYDE FREE PRINT BINDER

FIELD OF THE INVENTION

This invention relates to polymeric print binders for high quality prints or pad dyeing woven, knit, or non-woven fabrics such as cellulose, acetate, polyester/cellulose blends, and the like. The present invention is especially useful where low or no formaldehyde emitting applications are involved.

BACKGROUND OF THE INVENTION

Printed fabrics, including non-woven, woven, and knitted fabrics, are often printed with pigments to produce an attractive design or color pattern on the cloth. The pigment printing basically uses pigments, thickeners, and binders, while pad dyeing typically consists of pigments and binders. The pigment printed fabric must have acceptable fastness properties. These performance requirements are evaluated by tests such as the hand, crock, and wash fastness. It is also desirable for the pigment system to have good redispersibility.

The binder for pigment printing or pad dyeing which meet the performance requirements have, until recently, contained formaldehyde or formaldehyde containing or generating compounds for crosslinking with the substrates. Recent efforts have been made to reduce the formaldehyde content of, or the free formaldehyde generated by, the binders, or to totally eliminate the formaldehyde component of binders, for environmental reasons. An example of a low formaldehyde-emitting binder for cellulose is U.S. Pat. Nos. 5,198,492 and 5,278,222, which are related patents, issued to Dennis P. Stack. Stack teaches an aqueous dispersion of discrete particles of a highly functionalized emulsion copolymer formed by the copolymerization of a mixture 10 phm to 60 phm of one or more water-soluble polymerizable olefinically unsaturated non-ionic organic compounds and the balance of the mixture being a mixture of comonomers, including one or more water-soluble olefinically unsaturated organic compounds having at least one carboxylate group therein and one or more water-soluble olefinically unsaturated carboxylic acid hydroxy esters or olefinically unsaturated amides. The highly functionalized emulsion copolymer is a low solids composition which is used in conjunction with a latex polymer to constitute a binder for cellulose. That is, Stack teaches a two part latex composition which constitutes the binder.

BRIEF DESCRIPTION OF THE INVENTION

The present invention has resulted from the discovery that a latex, which comprises a copolymer of a dicarboxylic acid, a functional monomer, such as a hydroxy alkyl acrylate, and a backbone monomer or monomers, and a phosphate ester emulsifier, produces a print binder having improved performance and excellent redispersibility. The print binder is useful for producing pigment prints with good dry and wet crock, a soft to medium hand, and good wash fastness. The binder of the present invention does not require formaldehyde containing or generating cross linking agents and so is considered to be formaldehyde free, although it could be used in conjunction with formaldehyde generating crosslinking agents such as N-methylol acrylamide or NMA. Since it would require only small amounts of NMA, if used, it would be useful as a low formaldehyde binder system as well.

DETAILED DESCRIPTION OF THE INVENTION

The present invention is directed to a formaldehyde-free print binder which is a copolymer of a dicarboxylic acid monomer, a functional monomer, such as a hydroxy alkyl acrylate, and backbone monomer(s), in combination with a phosphate ester emulsifier. The print binder polymer employed can be, for example, a latex co-polymer of hydroxyethyl acrylate, itaconic acid, ethyl acrylate, N-butyl acrylate, acrylonitrile, acrylamide, and styrene, where the polymerization is done in the presence of the phosphate ester emulsifier. The polymer will comprise 80 to 99.75% by weight backbone monomer components, in combination with up to 20% by weight of dicarboxylic acid and functionalized monomer components, but individually these components will be present in amounts in the range of 0.1 to 15% by weight based upon the weight the polymer or parts per hundred resin monomer (phr) for the dicarboxylic acid, while the functional monomer is present in the range of 0.1 to 10 phr. The use of at least one backbone monomers with some solubility in water is preferred because better fastness properties are achieved, which properties will approach those polymer systems that contain formaldehyde cross linkers.

The functionalized monomers are olefinically unsaturated monomers, which have a functionality that, in combination with a dicarboxylic acid, will allow the polymer to crosslink to itself and/or to the substrate to a degree that a print binder will be effective without the use of a formaldehyde containing cross linking agent and is present in an amount of from about 0.1 to about 10% by weight of the polymer, with the range of 0.5 to 5 phr being preferred, and 1 to 3 phr being further preferred. An example of the functional monomer is a hydroxy alkyl (meth)acrylate, and hydroxy ethyl acrylate is preferred.

The functional monomer is represented by the following formula:

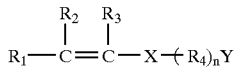

where $R_1$, $R_2$ and $R_3$ are hydrogen or a methyl group, $R_4$ is an alkyl containing 1 to 4 carbon atoms, n is 0 or 1, X is selected from the group consisting of hydrogen, carboxyl, phenyl, aryl, alkyl or alkaryl groups containing 1 to 30 atoms,

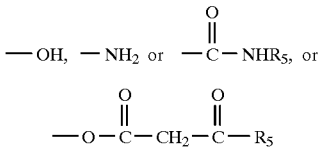

wherein $R_5$ is a hydrogen, an alkyl containing 1–20 carbon atoms, or an aryl group. The latter is an enol forming group, such as an acetoacetoxy or the like.

The olefinically unsaturated dicarboxylic acid is present in an amount of between about 0.1 to 15 phr, with the range of 0.5 to 5 being preferred, and the range of 1 to 3 being further preferred. Dicarboxylic acids that could be employed include itaconic acid, citraconic acid, maleic acid, and fumaric acid, with itaconic acid being preferred. Variation in the polymerization process may be necessary to employ dicarboxylic acids other than itaconic acid, for example by using a solution polymerization process instead of the emulsion polymerization process, which is preferred.

The backbone monomer will dictate the character of the polymer which will have a $T_g$ of between about −60 and +60° C. The precise requirements for the $T_g$ will vary depending on the use of the polymer for pigment printing or pigment padding binders. This variation can be achieved by the inclusion of one or more backbone monomers which can be soft or hard monomers and will result in a polymer having a relatively low or high $T_g$. For example, the addition of acrylic acid ester(s), butadiene, or ethylene can produce a polymer which has a relatively low $T_g$, while the addition of a monomer such as styrene, or other styrenic monomer, such as alpha methyl styrene, acrylonitrile, methacrylic ester(s), vinyl acetate, vinyl halide can produce a polymer which has a relatively high $T_g$. For convenience, a monomer which produces a polymer having a relatively low $T_g$, e.g., equal to or below about 10° C., will be referred to as a low $T_g$ monomer, while a monomer which produces a polymer having relatively high $T_g$, e.g., above about 10° C. will be referred to as a high $T_g$ monomer. By varying the ratios of the monomers a latex polymer having a $T_g$ appropriate for its use as a binder can be produced. The backbone monomers can be present in an amount of from 80 to 99.8 parts per hundred resin, monomer or phr, preferably 88 to 98%.

The acrylic acid esters are acrylate ester monomers of acrylic acid that have the following formula:

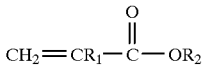

where $R_1$ is hydrogen or a $C_1$ to $C_8$ alkyl and $R_2$ is selected from the group consisting of an alkyl radical containing 1 to 18 carbon atoms, an alkoxyalkyl radical containing a total of 1 to 10 carbon atoms, and a cyanoalkyl radical containing 1 to 10 carbon atoms. The alkyl structure can contain primary, secondary, or tertiary carbon configurations and normally contains 1 to 8 carbon atoms. Examples of acrylic ester monomers are methyl acrylate, ethyl acrylate, propyl acrylate, lauryl acrylate, n-butyl acrylate, isobutyl acrylate, n-pentyl acrylate, isoamyl acrylate, n-hexyl acrylate, 2-methylpentyl acrylate, n-octyl acrylate,2-ethylhexyl acrylate, n-decyl acrylate, n-dodecyl acrylate, n-octadecylt acrylate, and the like; methyl methacrylate, butyl methacrylate, ethyl methacrylate, and the like; methoxymethyl acrylate, methoxymethyl acrylate, ethoxyethyl acrylate, butoxy ethyl acrylate, ethoxypropyl acrylate, and the like; a, β-cyanoethyl acrylate, α, β- and γ-cyanopropyl acrylate, cyanobutyl acrylate, cyanohexyl acrylate, cyanooctyl acrylate, and the like; hydroxyalkyl acrylates as hydroxyethyl acrylates and the like and mixtures thereof.

More preferred are the acrylate esters wherein $R_1$ is H or $CH_3$ and $R_2$ is an alkyl radical containing 1 to about 8 carbon atoms. Examples of preferred monomers are ethyl acrylate, n-butyl acrylate, 2-ethylhexyl acrylate, and the like; methyl methacrylate, butyl methacrylate, and the like; and mixtures thereof.

The use of backbone monomers with some water solubility is preferred because better fastness properties are achieved. Monomers with some water solubility, for the purpose of this application, include monomers with a water solubility equal to or greater than 0.5%, at room temperature, which monomer will be referred to as water soluble monomers. They would be employed as at least one of the backbone monomer in amounts of between about 2 and 98% by weight of the backbone monomer employed in the polymer. Examples of water soluble monomers include alkyl (meth)acrylates, such as methyl and ethyl acrylate, methyl methacrylate, (meth)acrylic acids, such as acrylic and methacrylic acid, methacrylamide, acrylamide, acrylonitrile, methoxy ethyl acrylate, N-methylol acrylamide, vinyl acetate, vinyl chloride, 2-vinyl pyridine, and the like. Some of these water soluble monomers employed have a solubility of greater than 15% in water, such acrylic and methacrylic acid, acrylamide, N-methylol acrylamide. The use of these more water soluble monomers enhances the redispersiblilty of the print binder. When these more water soluble monomers are employed, they should be used in amounts of less than or equal to 15% by weight of the water soluble monomers employed, preferably less than or equal to 4%, with ≦2% being further preferred.

The polymers of the present invention can be made by emulsion, dispersion, precipitation suspension polymerization, or by solution polymerization utilizing polar and/or non-polar solvents. The preferred method is the emulsion polymerization method. This process is generally conducted in the presence of water, an emulsifier or emulsifiers, and an initiator or initiators, as well as other such polymerization aids, with the preferred emulsifier being a phosphate ester. The process typically produces a latex containing more than 25% by weight solids, preferably more than 30% by weight solids, which is usable per se as a binder without having to be combined with other latex polymers. The precise amount of solids will depend upon the monomers chosen as well as the polymerization steps and other ingredients, and can be adjusted to meet customer needs.

The phosphate ester is preferably employed in the polymerization process, although it could be added to the latex after polymerization, that is, it could be post-added to the latex. The preferred phosphate ester is a mixture of mono- and di-phosphate esters with some unreacted non ionic base molecule, the nonyl phenol ethoxylate. It may also contain some unreacted phosphoric acid and some triesters. The phosphate ester of the present invention is a mixture having the formula $[R—(CH_2CH_2O)_n—]_mPO(OM)_x$, where R is the residue of a fatty alcohol, acid, amide, or amine having 8 to 12 carbon atoms, phenol, or an alkyl phenol having 8 to 20 carbon atoms in the alkyl group or other aromatic group with typically a $C_8$ to $C_{20}$ alkyl group, M is H, Na, K, or $NH_4$, m is 1, 2 or 3, m+x=3, and n is 1 to 100. Some specific examples of poly(oxyethylene) phosphates which can be used include the phosphate mono- and diesters of cetyl, oleyl, lauryl, and tridecyl poly(oxyethylene) ethanol ethers and the phosphate mono- and diesters of octyl and nonylphenyl poly(oxyethylene) ethanol ethers. The further preferred phosphate esters are Dextrol® OC-15 which contains 4 to 5 moles of ethylene oxide and is a mixture of about 32% mono-ester, 32% di-ester, and 4% tri-ester, with the balance (about 30%) being nonionic surfactant, namely unreacted nonyl phenol ethoxylate, while Dextrol® OC-22 contains 9 to 10 moles of ethylene oxide and is a mixture of about 54% mono-ester, 38% di-ester, and 1% tri-ester, with the balance (about 7%) being a unreacted nonionic surfactant, such as unreacted nonyl phenol ethoxylate. Both of these phosphate esters are commercially available from The Dexter Chemical Company. Rhodofax PE-510 is another phosphate ester that could be employed in the present invention, and it is commercially available from The Rhone-Poulenc Company.

The use of a phosphate ester emulsifier, either alone or in combination with conventional emulsifiers which may be required, produces an unexpectedly superior performing pigment binder. Examples of other anionic emulsifiers or surfactants include alkali metal or ammonium salts of the sulfates of alcohols containing 8 to 18 carbon atoms such as sodium lauryl sulfate, alkali metal and ammonium salts of sulfonated petroleum and paraffin oils, sodium salts of sulfonic acids, alkylaryl sulfonates, alkali metal and ammonium salts of sulfonated dicarboxylic acid esters, and the like. Nonionic emulsifiers such as octyl or nonylphenyl polyethoxyethanol and block copolymers of ethylene and propylene oxides can also be used. Latexes of excellent stability can be prepared with emulsifiers selected from alkali metal and ammonium salts of alkylated aromatic sulfonic acids, alkyl and alkylaryl sulfonates, alkyl sulfates, and alkyl or arylalkyl poly(oxyalkylene) sulfonates.

The amount of emulsifiers can vary between about 0.1 to 15 parts by weight per 100 parts by weight of the monomers, and excellent results can be obtained with 1 to 8 part of emulsifier(s). The latexes described herein are more preferably prepared using moderate levels of emulsifiers in the range of 1 to 6 dry parts per 100 parts of monomers.

The polymerization of the latex monomers disclosed herein can be conducted at temperatures of about 5° C. to about 99° C., typically about 50° to about 90° C., in the presence of a compound capable of initiating polymerization. Commonly used free radical initiators include the various peroxides, t-butyl hydroperoxide, and cumene hydroperoxide; and azo compounds such as azodiisobutyronitrile and dimethylazodiisobutyrate. Particularly useful initiators arc the water-soluble peroxygen compounds such as hydrogen peroxide and the sodium, potassium and ammonium persulfates used by themselves or in an activated redox system. Typical redox systems include alkali metal persulfates in combination with a reducing substance such as polyhydroxy compounds, oxidizable sulfur compounds, reducing sugars, dimethylaminopropionitrile, and a water-soluble ferrous compound. Polymer latexes with excellent stability can be obtained using alkali metal and ammonium, sodium, or potassium persulfate initiators. The amount of initiator used will generally be in the range of 0.01 to 3% by weight, based on the weight of the monomers, preferably between 0.1 and 1%. The initiator can be charged at the outset of the polymerization, however, incremental addition of the initiator throughout polymerization can also be employed and is often advantageous.

The polymerization procedure utilized consists of the initial preparation in a premix pot of premix of the monomers with emulsifier(s) and about ⅓ of the water used in the reaction, with the remainder being placed in the reactor. A small amount of ammonium hydroxide is added to the premix to neutralize the phosphate ester emulsifier used, which is supplied in the acid form. The remainder of the water employed in the recipe is added to the reactor, equipped with an agitator, thermometer, and a reflux condenser. The reactor is purged with nitrogen to minimize oxygen level and heated to about 80° C. After reaching the desired temperature, a portion of the initiator solution of ammonium persulfate is added to the reactor and metering of the premixed monomer(s) started over a 3-hour period. Additional amounts of persulfate solution (1% concentration) are added every hour to sustain good reaction rate. Once all of the premix was added to the reactor, the reaction temperature of 80–85° is maintained for 1.5 hours to essentially complete the polymerization of monomers to the polymer. All latexes are prepared to about 40%, usually 37 to 42% solids. At the end of the reaction, an oxidizing agent such as tertiary butyl hydroperoxide or t- BHP, and a reducing agent, such as erythrobic acid solution, were added to minimize free monomers in the latex (as is typical for latex processes to reduce or minimize the residual monomer). In order to keep the system formaldehyde free, reducing or redox agents such as sodium formaldehyde sulfoxylates or zinc formaldehyde sulfoxylates should be avoided. Otherwise, this is not a critical step and all normal redox agents can be used.

Typical polymerization for the preparation of the acrylic ester latexes described herein is conducted by charging the reactor with appropriate amount of water, emulsifier and electrolyte, if any is employed, and the full amount of the initiator to be used in the polymerization. The amount of initiator used is typical for the amount used in latex polymerization, usually in amount of about 0.1 to 1 parts per 100 parts of monomer. The preferred emulsifier to be employed is a phosphate ester such as Dextrol® OC 15 or OC-22 available from The Dexter Chemical Company. The reactor is then evacuated, heated to the initiation temperature. The initiator is then added to the reactor and the premix is metered into the reactor. The rate of proportioning may be varied depending on the polymerization temperature, the cooling capacity, the particular initiator employed and the type of the monomer(s) being polymerized. The rate of polymerization and free monomers can be controlled by metering in additional initiator solution. After all the components have been charged, the reaction is run for a length of time necessary to achieve the desired conversion. The pH of the latex can be in the range of about 1.5 to about 10. The preferred pH range is from 2 to 5. In order to further understand the present invention, a specific example is presented hereinafter.

EXAMPLE 1

Step 1—Premix and Monomers Preparation

In a premix container equipped with a high speed agitator blade, 432.0 grams of warm demineralized (DM) water was added, along with 27.0 grams of Dextrol® OC-15 emulsifier and 1.93 grams of ammonium hydroxide (28% concentration). These were mixed well for several minutes, then 18.0 grams of itaconic acid was added and dissolved. Next, while mixing, 18.0 grams of 2-hydroyx ethyl acrylate, 17.31 grams of acrylamide (52% concentration) and 855.0 grams of ethyl acrylate were added. This produced a smooth creamy white emulsion.

Step 2—Reactor Preparation

In a three neck, three liter flask, equipped with an agitator blade, a nitrogen purge, thermometer, and condenser, to serve as a reactor, 769.5 grams of DM water was added. The reactor was purged with nitrogen to minimize oxygen level and heated to 77° C. Next, 2.25 grams of ammonium persulfate was disolved in 23.9 grams of water and added to the reactor. The metering in of the premixed monomers was begun and this was continued over a 3 hour period. Next, 0.9 grams of ammonium persulfate, predisolved in 93.8 grams of DM water, was divided into equal portions and added to the reactor at 1,2,3, and 4 hour time periods. Once all of the premix monomers were added to the reactor, the reaction temperature of 82° C. was maintained over 1.5 hours to essentially complete the polymerization of the monomers to the polymer. At the end of the reaction, 2.3 grams of t-BHP, premixed with 9.0 grams of DM water, was added to the reactor, followed by 0.72 grams of ethorbic acid and 27.0 grams of DM water to further reduce free monomers. Finally, the latex was filtered through four layers of cheese cloth and yielded a latex having a pH of 2.8, a solids content of 37.7, and a BV viscosity (1–60 LVF) of 7.5. This latex binder is reported in Table I as Example 2. Other binders were prepared using essentially the same procedure, but with the variations shown in Table I.

The latexes described herein are often compounded with, other known ingredients such as emulsifiers, crosslinking agents, curing agents, catalysts fillers, plasticizers, softeners antioxidants or stabilizers, antifoaming agents, dying adjuvants, pigments, or other compounding aids. Furthermore, thickeners or bodying agents are generally added to the polymer latexes so as to control the viscosity of the latexes and thereby achieve the proper flow properties for the particular application desired.

Specifically, the latexes described herein are suitable for use as binders for pigments for printing on natural materials and blends of natural materials with synthetics; woven textile fabrics,; nonwoven fabrics made by bonding natural, synthetic, or a mixture of such fibers; woven fabrics treated or untreated with a latex binder or any other additive(s) and knit fabrics of natural and synthetic blends, and paper made by bonding cellulosic fibers. A variety of fibers could be bonded including glass, nylon, polyester, rayon, carbon, cellulose, or mixtures thereof. These fibers can be woven or knitted in to a fabric or could be a non-woven web made by a wet laid or dry laid process.

Among the wide variety of print applications that can be listed for the latex binders described herein, many of these products require a desirable degree of water resistance, as indicated by their colorfastness to laundering.

Latexes of the present invention can be applied to the substrate in any suitable print process such as spraying, dipping, roll-transfer, brushing, padding, rolling, flat bed, rotary, or the like.

The following examples are presented for purpose of illustrating the invention disclosed herein in greater detail. In these examples, latex polymers were made using various backbone monomers, and surfactants, as noted in Table I, with and without a dicarboxylic acid monomer or monomers and/or a functional monomer or monomers. These were then used to print cloth and the results are shown in Table I. The examples are not, however, to be construed to limit the invention herein in any manner, the scope of which is defined by the appended claims.

In the examples, the following abbreviations were used:

| | |
|---|---|
| ITA | Itaconic Acid |
| 2EHA | 2 ethyl hexyl acrylate |
| ACN | acrylonitrile |
| EA | ethyl acrylate |
| nBA | n-butyl acrylate |
| STY | styrene |
| ACM | acrylamide |
| MA | methyl acrylate |
| HEA | hydroxy ethyl acrylate |
| SLS | sodium lauryl sulfate |
| AOS | alpha olefin sulfonate |
| DCA | dicarboxylic acid |
| Dextrol ® OC-15 & OC-22 | mixtures of nonyl phenol ethoxylate phosphate esters (available from Dexter Chemical Company) |
| DOWPAX ® 2A1 | sodium dodecyl diphenyloxide disulfonate (available from the Dow Chemical Company) nonylphenoxy |
| Igepal ® CO-887 | poly(ethyleneoxy) ethanol (available from Rhone-Poulenc) |

The sample printed cloth was produced and evaluated according to the following test methods:

Manufacture of Sample Printed Cloth

A 65/35 polyester/cotton sheeting fabric was printed using Johannes Zimmer mini MDK laboratory flat bed printing machine and the following formulation:

| Ingredient | % by Weight |
|---|---|
| Water | 78 |
| Thickener (Carbopol PRT polymer, having 35% actives) | 2 |
| Binder (e.g., the polymer of the present invention, having about 40% actives) | 10 |
| Pigment (Acramine Blue 3GNE, having about 15% actives) | 10 |
| | 100% |

Print Paste Mixing Procedure:

A. In a suitable mixing vessel equipped with a stirrer, add 2 gm thickener to 78 gm water and mix for 1 minute at 70 rpm.

B. Add 10 gm binder and 10 gm pigment and mix for 2 minutes at 70 rpm.

C. Record the viscosity using a No. 6 spindle at 20 rpm.

D. Adjust the amount of thickener to achieve the target viscosity of 14,000 to 16,000 centipoise.

The minimum amount of binder in the print paste should be 5 %. The maximum amount of pigment should be 25%. When the pigment concentration is between 3 and 10%, the pigment to binder ratio should be 1:1, and thereafter 1:1.5 up to the maximum amount of the pigment.

Printing of Cloth:

The following steps were employed:

a) A pattern was printed using a 160-mesh screen.

b) The printed fabric was placed straight in the oven for 3 minutes at 350° C.

c) The fabric was then conditioned for 2 hours at room temperature.

d) Finally, the fabric was evaluated for the fastness and other properties.

Color Test

The color is measured using a calorimeter. A standard is established which is considered as 100, and so a reading of ±5% is considered acceptable. For example, if the standard chosen is print using formaldehyde containing commercial binders, then acceptable colors are those within 5% of the reading for the standard.

Hand Test

In order to measure the "hand" or relative softness or handle ability of the printed fabric, they were measured on a Thwing-Albert Handle-O- Meter, in accordance with the instructions on the machine. The quality of "hand" is considered to be the combination of resistance due to the surface friction and flexibility of a sheet material. The Handle-O-Meter uses a linear variable differential transformer to detect the resistance that a blade encounters when forcing a specimen of material into a slot of parallel edges. A digital voltmeter indicates the resistance in grams. The value is the average of four readings. A lower reading is considered to be good, so the higher the reading, the stiffer the hand. Since this is a comparative test, a target is the hand of the control material plus or minus 5.

Crocking Test

The crocking test is designed to determine the amount of color transferred from the surface of colored textile materials under fiction. This simulates the friction encountered, for example, between a bed sheet and a night dress while sleeping in bed. The test is performed in accordance with AATCC (American Association of Textile Chemists and Colors) Test Method 8-1989. The test results will range from Grade 1 to 5, with Grade 5 being the best and producing a result where negligible or no color transfer occurs. A value of 3 or more is considered good. A value of equal to or more than 2.0 for wet crock is acceptable, while a dry crock of 2.5 or more is acceptable.

Wash Fastness Test

The wash fastness or colorfastness to laundering test is an accelerated laundering test designed for evaluating the colorfastness to laundering of textiles which are expected to withstand frequent laundering. The test is performed in accordance with AATCC Test Method 61-1989, part IIA, which is also known as the "IIA Test". The loss of color due to laundering is reported as a negative number. It relates to the % loss of original color before the test is performed. Higher color loss represents poor wash fastness properties.

TABLE I

| | Functional Monomers | | Backbone Monomers | | Surfactant | | | | | II A Wash |
|---|---|---|---|---|---|---|---|---|---|---|
| Example No. | DCA ITA | HEA | Type | % by wt. | Kind | % by wt. | Hand | Dry Crock | Wet Crock | (% Color Loss) |
| 1 | PrintRite ® 595 binder | | | | | | 16.1 | 3.0 | 3.25 | 21.9 |
| 2 | 2.0 | 2.0 | EA | 95.0 | OC-15 | 3.0 | 15.65 | 3.25 | 3.5 | 29.2 |
| | | | ACM | 1.0 | | | | | | |
| 3 | 2.0 | 2.0 | EA | 95.0 | OC-22 | 3.0 | 16.7 | 3.0 | 3.0 | 36.1 |
| | | | ACM | 1.0 | | | | | | |
| 4 | 2.0 | 2.0 | EA | 95.0 | SLS | 3.0 | 20.5 | 3.0 | 2.75 | 59.1 |
| | | | ACM | 1.0 | | | | | | |
| 5 | 2.0 | 2.0 | EA | 95.0 | AOS | 3.0 | 19.4 | 3.0 | 3.0 | 47.7 |
| | | | ACM | 1.0 | | | | | | |
| 6 | 2.0 | 2.0 | EA | 95.0 | Dowfax | 3.0 | 20.5 | 3.0 | 3.0 | 49.2 |
| | | | ACM | 1.0 | 2A1 | | | | | |
| 7 | 2.0 | 2.0 | EA | 95.0 | Igepal | 3.0 | 13.6 | 3.0 | 3.25 | 40.15 |
| | | | ACM | 1.0 | CO-887 | | | | | |
| 8 | 2.0 | 2.0 | EA | 95.0 | OC-22 | 2.0 | 15.55 | 3.25 | 3.5 | 31.7 |
| | | | ACM | 1.0 | Igepal | 1.0 | | | | |
| | | | | | CO-887 | | | | | |
| 9 | 2.0 | 4.0 | EA | 93.0 | OC-22 | 3.0 | 16.8 | 3.25 | 3.0 | 36.8 |
| | | | ACM | 1.0 | | | | | | |
| 10 | 2.0 | 8.0 | EA | 89.0 | OC-22 | 3.0 | 18.85 | 3.0 | 3.0 | 41.3 |
| | | | ACM | 1.0 | | | | | | |
| 11 | 2.0 | 2.0 | EA | 96.0 | OC-22 | 3.0 | 16.6 | 3.0 | 3.25 | 34.4 |
| 12 | 4.0 | 2.0 | EA | 93.0 | OC-22 | 3.0 | 20.8 | 3.0 | 3.25 | 35.7 |
| | | | ACM | 1.0 | | | | | | |
| 13 | 2.0 | 2.0 | EA | 95.0 | SLS | 0.3 | 19.3 | 3.0 | 3.0 | 41.0 |
| | | | ACM | 1.0 | OC-22 | 3.0 | | | | |
| 14 | 2.0 | 0.0 | EA | 97.0 | OC-15 | 3.0 | 18.5 | 2.75 | 2.75 | 34.1 |
| | | | ACM | 1.0 | | | | | | |
| 15 | 2.0 | 2.0 | EA | 95.0 | SLS | 0.3 | 18.2 | 3.0 | 3.0 | 32.7 |
| | | | ACM | 1.0 | OC-15 | 3.0 | | | | |
| 16 | 0.0 | 2.0 | EA | 97.0 | OC-15 | 3.0 | 16.8 | 2.75 | 3.0 | 48.4 |
| | | | ACM | 1.0 | | | | | | |
| 17 | 2.0 | 2.0 | EA | 66.0 | OC-22 | 3.0 | 20.6 | 3.0 | 3.25 | 27.5 |
| | | | nBA | 15.5 | | | | | | |
| | | | STY | 13.0 | | | | | | |
| | | | ACM | 1.0 | | | | | | |
| 18 | 2.0 | 0.0 | nBA | 67.0 | OC-15 | 3.0 | 16.6 | 2.75 | 2.5 | 46.7 |
| | | | STY | 30.0 | | | | | | |
| | | | ACM | 1.0 | | | | | | |
| 19 | 2.0 | 2.0 | nBA | 65.0 | OC-15 | 3.0 | 17.85 | 3 | 3 | 42.2 |
| | | | STY | 30.0 | | | | | | |
| | | | ACM | 1.0 | | | | | | |
| 20 | 0.0 | 0.0 | nBA | 69.0 | OC-15 | 3.0 | 15.1 | 2.75 | 2.25 | 76.9 |
| | | | STY | 30.0 | | | | | | |
| | | | ACM | 1.0 | | | | | | |
| 21 | 2.0 | 0.0 | nBA | 67.0 | SLS | 3.0 | 17.3 | 3.0 | 2.75 | 50.6 |
| | | | STY | 30.0 | | | | | | |
| | | | ACM | 1.0 | | | | | | |
| 22 | 2.0 | 0.0 | nBA | 68.0 | OC-15 | 3.0 | 15.8 | 3.0 | 2.5 | 56.5 |
| | | | STY | 30.0 | | | | | | |
| 23 | 2.0 | 0.0 | MA | 10.0 | OC-15 | 3.0 | 19.6 | 3.0 | 2.25 | 39.6 |
| | | | EA | 10.0 | | | | | | |
| | | | nBA | 38.0 | | | | | | |
| | | | 2-EHA | 10.0 | | | | | | |
| | | | ACN | 10.0 | | | | | | |
| | | | STY | 10.0 | | | | | | |
| | | | MMA | 10.0 | | | | | | |
| 24 | 2.0 | 2.0 | MA | 10.0 | OC-15 | 3.0 | 19.75 | 3.0 | 2.75 | 23.7 |
| | | | EA | 10.0 | | | | | | |
| | | | nBA | 36.0 | | | | | | |
| | | | 2-EHA | 10.0 | | | | | | |
| | | | ACN | 10.0 | | | | | | |

TABLE I-continued

| Example No. | DCA ITA | Functional Monomers HEA | Backbone Monomers Type | % by wt. | Surfactant Kind | % by wt. | Hand | Dry Crock | Wet Crock | II A Wash (% Color Loss) |
|---|---|---|---|---|---|---|---|---|---|---|
| | | | STY | 10.0 | | | | | | |
| | | | MMA | 10.0 | | | | | | |
| 25 | 2.0 | 2.0 | MA | 10.0 | OC-15 | 3.0 | 21.5 | 2.75 | 2.5 | 28.3 |
| | | | EA | 10.0 | | | | | | |
| | | | nBA | 35.0 | | | | | | |
| | | | 2-EHA | 10.0 | | | | | | |
| | | | ACN | 10.0 | | | | | | |
| | | | STY | 10.0 | | | | | | |
| | | | MMA | 10.0 | | | | | | |
| | | | ACM | 1.0 | | | | | | |
| 26 | 2.0 | 2.0 | MA | 10.0 | SLS | 3.0 | 23.1 | 2.75 | 2.5 | 44.4 |
| | | | EA | 10.0 | | | | | | |
| | | | nBA | 35.0 | | | | | | |
| | | | 2-EHA | 10.0 | | | | | | |
| | | | ACN | 10.0 | | | | | | |
| | | | STY | 10.0 | | | | | | |
| | | | MMA | 10.0 | | | | | | |
| | | | ACM | 1.0 | | | | | | |

As can be seen from Examples 2 to 8, the use of the phosphate ester provides a binder having comparable performance to PrintRite® 595 binder, a commercial binder which employs a formaldehyde containing cross-linking agent. Direct comparison between Examples 2 and 14, 18 and 19, and 23 and 24 demonstrate the importance of the inclusion of a functional monomer. Examples 2, as contrasted to Example 16, shows the importance of including a dicarboxylic acid monomer in the polymers of the present invention. The other examples show that, in general, there is a need for one backbone monomer with greater than 0.5% water solubility to achieve the desired properties.

The foregoing embodiments of the present invention have been presented for purposes of illustration and description. These description and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

We claim:

1. An aqueous dispersion for use as a print binder consisting essentially of 0.1 to 15 percent by weight of at least one phosphate ester emulsifier and a copolymer consisting essentially of the following monomer mixture:

(a) 0.2 to 15 percent by weight of at least one olefinically unsaturated dicarboxylic acid, (b) 0.1 to 10 percent by weight of at least one functional monomer which is represented by the following formula:

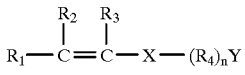

where $R_1$, $R_2$ and $R_3$ are hydrogen or a methyl group, $R_4$ is an alkylene containing 1 to 4 carbon atoms, n is 0 or 1, X is selected from the group consisting of carboxyl, phenylene, arylene, alkylene or alkarylene groups containing 1 to 30 atoms, and Y is a nucleophilic group selected

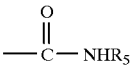

wherein $R_5$ is a hydrogen, an alkyl containing 1–20 carbon atoms, or an aryl group, and (c) more than 80% by weight of one or more backbone monomers selected from the group consisting of acrylic acid ester(s) having the following formula:

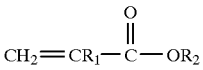

where $R_1$ is hydrogen or a $C_1$ to $C_8$ alkyl and $R_2$ is selected from the group consisting of an alkyl radical containing 1 to 18 carbon atoms, an alkoxyalkyl radical containing a total of 1 to 10 carbon atoms, and a cyanoalkyl radical containing 1 to 10 carbon atoms, butadiene, ethylene, styrene, alpha methyl styrene, acrylonitrile, vinyl acetate, vinyl halide, alkyl (meth)acrylates, (meth)acrylic acids, methacrylamide, acrylamide, acrylonitrile, methoxyethylacrylate 2- vinylpyridine vinyl acetate, and N-methylol acrylamide.

2. The dispersion of claim 1 wherein said dicarboxylic acid is present in an amount of 0.5 to 5.0% by weight based upon the weight of the polymer.

3. The dispersion of claim 1 wherein said dicarboxylic acid is present in an amount of 1.0 to 3.0% by weight based upon the weight of the polymer.

4. The dispersion of claim 1 wherein said dicarboxylic acid is present in an amount of 2.0% by weight based upon the weight of the polymer.

5. The dispersion of claim 1 wherein said functional monomer is present in an amount of 0.5 to 3.0% by weight based upon the weight of the polymer.

6. The dispersion of claim 1 wherein said functional monomer is present in an amount of 1.0 to 3.0% by weight based upon the weight of the polymer.

7. The dispersion of claim 1 wherein said functional monomer is present in an amount of 2.0% by weight based upon the weight of the polymer.

8. The dispersion of claim 1 wherein said dicarboxylic acid is itaconic acid.

9. The dispersion of claim 1 wherein said functional monomer is hydroxy ethyl acrylate.

10. The dispersion of claim 1 wherein said backbone monomers are selected from the group consisting of methyl acrylate, ethyl acrylate, n-butyl acrylate, styrene, acrylamide, 2-ethyl hexyl acrylate, methyl methacrylate, acrylonitrile, and mixtures thereof.

11. The dispersion of claim 1 wherein said backbone monomers include at least one water soluble monomer having a water solubility of greater than or equal to 0.5% by weight of the water soluble monomers employed.

12. The dispersion of claim 11 wherein said water soluble monomer is selected from the group consisting of, methyl acrylate, ethyl acrylate, acrylic acid, methacrylic acid, methyl methacrylate, methacrylamide, acrylamide, acrylonitrile, methoxy ethyl acrylate, N-methylol acrylamide, vinyl acetate, 2-vinyl pyridine, and mixtures thereof.

13. The dispersion of claim 11 wherein said water soluble monomer is ethyl acrylate.

14. The dispersion of claim 1 wherein said phosphate ester is added during the polymerization process.

15. The dispersion of claim 1 wherein said phosphate ester is added after the monomers are polymerized.

16. A method of making an aqueous dispersion for use as a print binder, said dispersion consisting essentially of 0.1 to 15 percent by weight of at least one phosphate ester emulsifier and a copolymer consisting essentially of the following monomer mixture polymerized in the presence of said phosphate ester emulsifier:

a) 0.2 to 15 percent by weight of at least one dicarboxylic acid, b) 0.1 to 10 percent by weight of at least one functional monomer which is represented by the following formula:

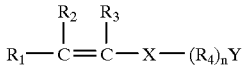

where $R_1$, $R_2$ and $R_3$ are hydrogen or a methyl group, $R_4$ is an alkylene containing 1 to 4 carbon atoms, n is 0 or 1, X is selected from the group consisting of hydrogen, carboxyl, phenyl, aryl, alkyl or alkaryl groups containing 1 to 30 atoms, and Y is a nuclephilic group selected from

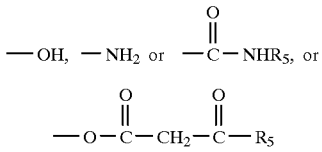

wherein $R_5$ is a hydrogen, an alkyl containing 1–20 carbon atoms, or an aryl group, and c) more than 80% by weight of one or more backbone monomers selected from the group consisting of acrylic acid ester(s) having the following formula:

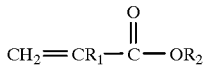

where $R_1$ is hydrogen or a $C_1$ to $C_8$ alkyl and $R_2$ is selected from the group consisting of an alkyl radical containing 1 to 18 carbon atoms, an alkoxyalkyl radical containing a total of 1 to 10 carbon atoms, and a cyanoalkyl radical containing 1 to 10 carbon atoms, butadiene, ethylene, styrene, alpha methyl styrene, acrylonitrile, vinyl acetate, vinyl halide, alkyl (meth)acrylates, (meth)acrylic acids, methacrylamide, acrylamide, acrylonitrile, methoxyethylacrylate 2- vinylpyridine vinyl acetate, and N-methylol acrylamide.

17. A pigment printing mixture consisting essentially of a pigment and an aqueous binder consisting essentially of 0.1 to 15 percent by weight of at least one phosphate ester emulsifier and a copolymer consisting essentially of the following monomer mixture:

a) 0.2 to 15 percent by weight of at least one dicarboxylic acid, b) 0.1 to 10 percent by weight of at least one functional monomer which is represented by the following formula:

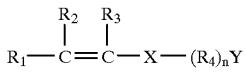

where $R_1$, $R_2$ and $R_3$ are hydrogen or a methyl group, $R_4$ is an alkylene containing 1 to 4 carbon atoms, n is 0 or 1, X is selected from the group consisting of hydrogen, carboxyl, phenyl, aryl, alkyl or alkaryl groups containing 1 to 30 atoms, and Y is a nucleophilic group selected from

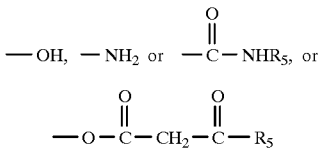

wherein $R_5$ is a hydrogen, an alkyl containing 1–20 carbon atoms, or an aryl group, and c) more than 80% by weight of one or more backbone monomers selected from the group consisting of acrylic acid ester(s) having the following formula:

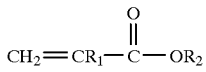

where $R_1$ is hydrogen or a $C_1$ to $C_8$ alkyl and $R_2$ is selected from the group consisting of an alkyl radical containing 1 to 18 carbon atoms, an alkoxyalkyl radical containing a total of 1 to 10 carbon atoms, and a cyanoalkyl radical containing 1 to 10 carbon atoms, butadiene, ethylene, styrene, alpha methyl styrene, acrylonitrile, vinyl acetate, vinyl halide, alkyl (meth)acrylates, (meth)acrylic acids, methacrylamide, acrylamide, acrylonitrile, methoxyethylacrylate 2- vinylpyridine vinyl acetate, and N-methylol acrylamide.

18. The mixture of claim 17 wherein said pigment is present in an amount of between 0.1 and 25 percent by weight based upon the weight of the pigment printing mixture.

19. The mixture of claim 17 wherein the pigment printing mixture has a viscosity of 10,000 to 30,000 centipoise.

20. The mixture of claim 17 wherein the pigment printing mixture further includes a thickener and the pigment printing mixture has a viscosity of 14,000 to 16,000 centipoise.

21. The dispersion of claim 1 which further includes a pigment.

22. The dispersion of claim 1 wherein said phosphate ester is a mixture of esters having the formula $(R—(CH_2CH_2O)_n—)_mPO(OM)_x$, where R is a fatty alcohol, fatty acid, fatty amide, or fatty amine having 8 to 12 carbon atoms, phenol, or an alkyl phenol having 8 to 20 carbon atoms in the alkyl group or other aromatic group with a $C_8$ to $C_{20}$ alkyl group, M is H, Na, K, or $NH_4$, mis 1,2 or 3, m+x=3, and n is 1 to 100.

23. The method of claim 16 wherein said phosphate ester is a mixture having the formula $(R—(CH_2CH_2O)_n—)_mPO(OM)_x$, where R is a fatty alcohol, fatty acid, fatty amide, or fatty amine having 8 to 12 carbon atoms, phenol, or an alkyl phenol having 8 to 20 carbon atoms in the alkyl group or other aromatic group with a $C_8$ to $C_{20}$ alkyl group, M is H, Na, K, or $NH_4$, m is 1,2 or 3, m+x=3, and n is 1 to 100.

* * * * *